US011801994B2

(12) United States Patent
Morrison et al.

(10) Patent No.: US 11,801,994 B2
(45) Date of Patent: Oct. 31, 2023

(54) RECEPTACLE AND LATCHING MECHANISM FOR RECEPTACLE GATE

(71) Applicants: Royal Truck and Trailer Sales and Service, Inc., Northville, MI (US); Edw. C. Levy Co., Dearborn, MI (US)

(72) Inventors: Michael Morrison, Brownstown, MI (US); Scott Chapman, Lincoln Park, MI (US); Sean Chapman, Lincoln Park, MI (US); Brian Billings, Commerce Township, MI (US); John Battles, Madison Heights, MI (US); Michael Robert Pollock, Oxford, MI (US); Brian Matthew Clark, Garden City, MI (US)

(73) Assignees: Royal Truck and Trailer Sales and Service, Inc., Northville, MI (US); Edw. C. Levy Co., Dearborn, MI (US)

( * ) Notice: Subject to any disclaimer, the term of this patent is extended or adjusted under 35 U.S.C. 154(b) by 0 days.

(21) Appl. No.: 17/742,329

(22) Filed: May 11, 2022

(65) Prior Publication Data

US 2022/0363471 A1 Nov. 17, 2022

Related U.S. Application Data

(60) Provisional application No. 63/187,096, filed on May 11, 2021.

(51) Int. Cl.

| | |
|---|---|
| ***B65D 90/62*** | (2006.01) |
| ***B65F 1/16*** | (2006.01) |
| ***B65D 90/66*** | (2006.01) |

(52) U.S. Cl.

CPC ..... *B65D 90/623* (2013.01); *B65D 90/66* (2013.01); *B65F 1/1646* (2013.01); *B65D 2590/666* (2013.01)

(58) Field of Classification Search

CPC ..... B65D 90/623; B65D 90/66; B65D 2590/666; B65F 1/1646

(Continued)

(56) References Cited

U.S. PATENT DOCUMENTS 3,077,841 A * 2/1963 Lunde ..... B61D 7/16 105/364
3,152,824 A * 10/1964 Bolling ..... B61D 7/16 292/216

(Continued)

FOREIGN PATENT DOCUMENTS

FR 3010988 A1 * 3/2015 ..... B65F 1/125

*Primary Examiner* — J. Gregory Pickett
*Assistant Examiner* — Niki M Eloshway
(74) *Attorney, Agent, or Firm* — Christopher G. Darrow; Darrow Mustafa PC

(57) ABSTRACT

A receptacle is provided for holding a quantity of solid material. The receptacle includes a container having an open end, and a gate operably connected to the container so as to be rotatable to a closed position structured to prevent solid material from exiting the container through the open end. The gate includes a locking arm mounted thereon. A latching mechanism is operably connected to the container and includes a latch rotatable to a latched orientation structured to contact the locking arm to prevent the gate from being rotated out of the closed position. The locking arm is structured to move rearwardly and upwardly during rotation of the gate out of the closed position. The latch is structured so that contact between the latch and the locking arm when the latch is in the latched orientation prevents rearward and upward movement of the locking arm.

18 Claims, 11 Drawing Sheets

(58) Field of Classification Search
USPC ..... 220/324
See application file for complete search history.

(56) References Cited

U.S. PATENT DOCUMENTS

| | | | | | |
|---|---|---|---|---|---|
| 4,142,751 | A * | 3/1979 | Varda | B65D 90/623 | 292/217 |
| 4,291,631 | A * | 9/1981 | Knippel | B61D 7/30 | 292/216 |
| 4,547,099 | A * | 10/1985 | Alexandrov | B65D 90/623 | 292/201 |
| 4,945,949 | A * | 8/1990 | Carpentier | B65D 90/66 | 137/613 |
| 5,639,129 | A * | 6/1997 | Lindley | B65F 3/00 | 292/145 |
| 6,808,080 | B2 * | 10/2004 | Spiers | B65F 1/1615 | 220/908 |
| 6,929,146 | B1 * | 8/2005 | Galbreath | B65F 3/00 | 220/908 |
| 10,252,855 | B1 * | 4/2019 | Melancon, Jr. | B65D 88/542 | |
| 2005/0023839 | A1 * | 2/2005 | Franich | B65F 1/1452 | 292/113 |
| 2011/0289851 | A1 * | 12/2011 | de Zwart | B65D 90/66 | 49/358 |
| 2020/0284073 | A1 * | 9/2020 | Thomas, II | E05C 1/002 | |

* cited by examiner

RECEPTACLE AND LATCHING MECHANISM FOR RECEPTACLE GATE

CROSS-REFERENCE TO RELATED APPLICATIONS

This application claims the benefit of U.S. Provisional Patent Application No. 63/187,096, filed on May 11, 2021, the disclosure of which is incorporated by reference herein in its entirety.

TECHNICAL FIELD

Embodiments described herein relate to a receptacles for receiving and storing waste and, more particularly, to a gate latching mechanism for a waste storage receptacle including a container having an open end and a gate operably connected to the container so as to be movable to open and close the container open end for removal of the waste from the container.

BACKGROUND

Large receptacles may be configured for receiving and storing various types of solid waste (such as scrap lumber, garbage, etc.) for later disposal. One use of such a receptacle may be, for example, as a "dumpster" which may be positioned at a construction site and used for depositing scrap construction materials therein.

A wall of the receptacle may be structured to be opened and closed to facilitate removal of waste therefrom. The wall may be hinged or otherwise rotatably connected to another portion of the receptacle. The receptacle may be provided with one or more latches structured to maintain the rotatable wall in a closed condition against the forces exerted by the contents of the receptacle until it is desired to rotate the wall open for waste removal.

Some problems exist with current receptacle designs. In general, the latches may be difficult to release under load when the receptacle is full of waste. Also, sudden release of the latches and the resulting loss of support forces holding the wall closed may cause the wall to swing open rapidly and uncontrollably while under load.

SUMMARY

In one aspect of the embodiments described herein, a receptacle is provided for holding a quantity of solid material. The receptacle includes a container having an open end, and a gate operably connected to the container so as to be rotatable to a closed position structured to prevent solid material from exiting the container through the open end. The gate includes a locking arm mounted thereon. A latching mechanism is operably connected to the container and includes a latch rotatable to a latched orientation structured to contact the locking arm to prevent the gate from being rotated out of the closed position. The gate is structured and operably connected to the container so that the locking arm moves rearwardly and upwardly during rotation of the gate in order to rotate the gate out of the closed position. The latch is structured so that contact between the latch and the locking arm when the latch is in the latched orientation prevents rearward and upward movement of the locking arm.

In another aspect of the embodiments described herein, a method of releasably securing a gate of a receptacle in a closed position is provided. The receptacle is structured for holding a quantity of solid material therein, and includes a container having an open end and a gate operably connected to the container so as to be rotatable to a closed position structured to prevent solid material from exiting the container through the open end. The gate is structured and operably connected to the container so that a portion of the gate moves rearwardly and upwardly during rotation of the gate in order to rotate the gate out of the closed position. The method includes steps of attaching a locking arm to the portion of the gate and operably connecting a latch to the container so as to be rotatable with respect to the container to a latched orientation and an unlatched orientation. The latch is structured to contact the locking arm when the latch is in the latched orientation so as to prevent rearward and upward motion of the locking arm during attempted rotation of the gate out of the closed position. The method also includes a step of rotating the latch into the latched orientation.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

A receptacle is provided for holding a quantity of solid material. The receptacle includes a container having an open end, and a gate operably connected to the container so as to be rotatable to a closed position structured to prevent solid material from exiting the container through the open end. The gate includes a locking arm mounted thereon. A latching mechanism is operably connected to the container and includes a latch rotatable to a latched orientation structured to contact the locking arm to prevent the gate from being rotated out of the closed position. The locking arm is structured to move rearwardly and upwardly during rotation of the gate out of the closed position. The latch is structured so that contact between the latch and the locking arm when the latch is in the latched orientation prevents rearward and upward movement of the locking arm. When rotated to an unlatched orientation, the latch still provides resistance against loads exerted by the material residing inside the receptacle. However, as the gate is rotated upwardly, the locking arm may be gradually lifted so as to slide along a surface of the latch, then out of contact with the latch.

Figure 1:
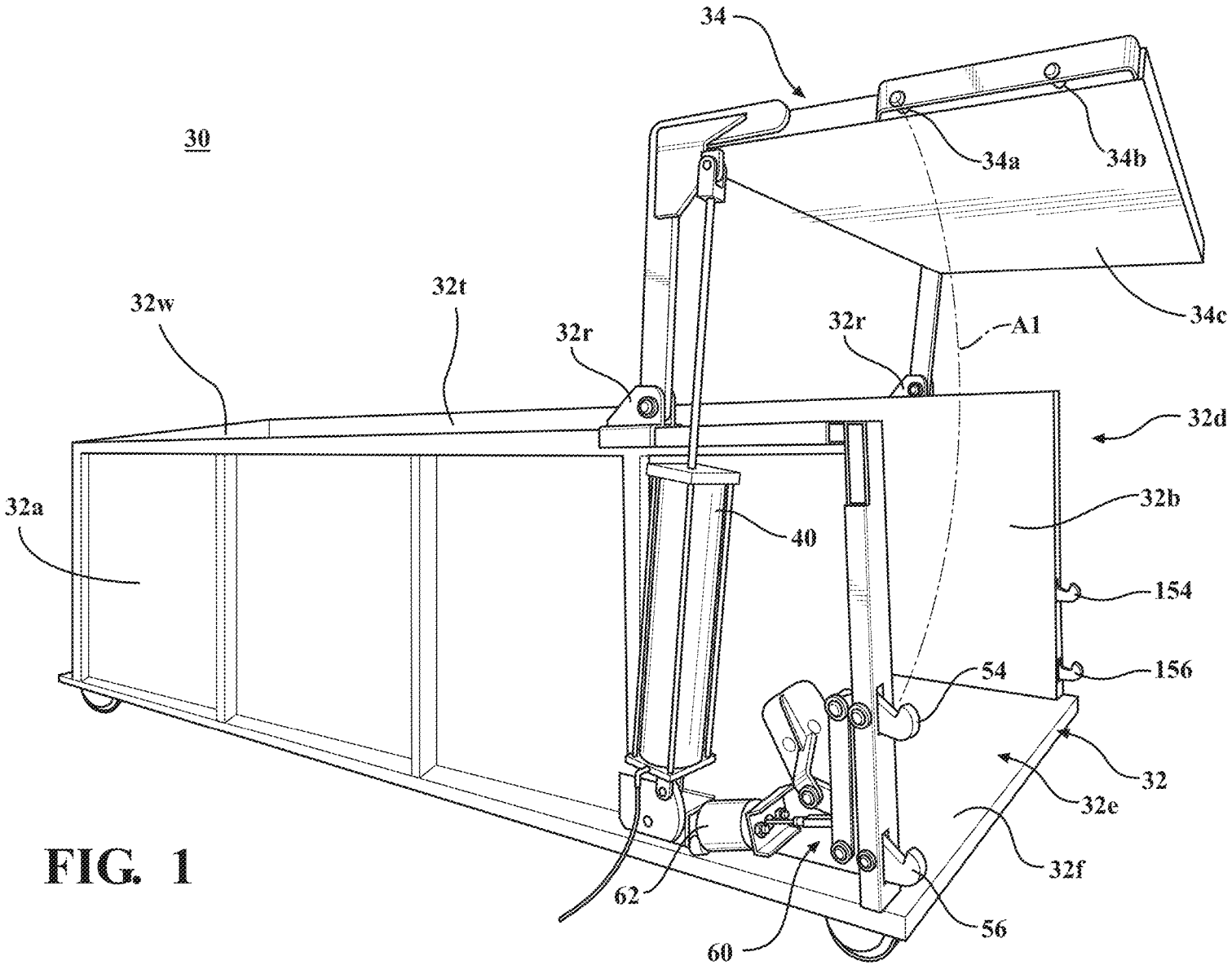
FIG. 1 is a schematic perspective view of a receptacle incorporating a latching mechanism in accordance with an embodiment described herein.

Referring to the drawings, and particularly to FIG. 1, the receptacle 30 may include a container 32. The container 32 may have a pair of opposed sidewalls 32*a*, 32*b*, an endwall 32*w* extending between the sidewalls 32*a*, 32*b* at a closed, front end of the container, and an open end 32*d* of the container opposite the endwall 32*w*. The container 32 may also have a floor 32*f* extending between the sidewalls 32*a*, 32*b* and the endwall 32*w*. In combination, the endwall 32*w*, the floor 32*f* and the sidewalls 32*a*, 32*b* may define an interior space 32*e* of the container 32. The container 32 may also have an open top 32*t* defined by uppermost edges of the sidewalls 32*a*, 32*b* and the endwall 32*w*.

Figure 2:
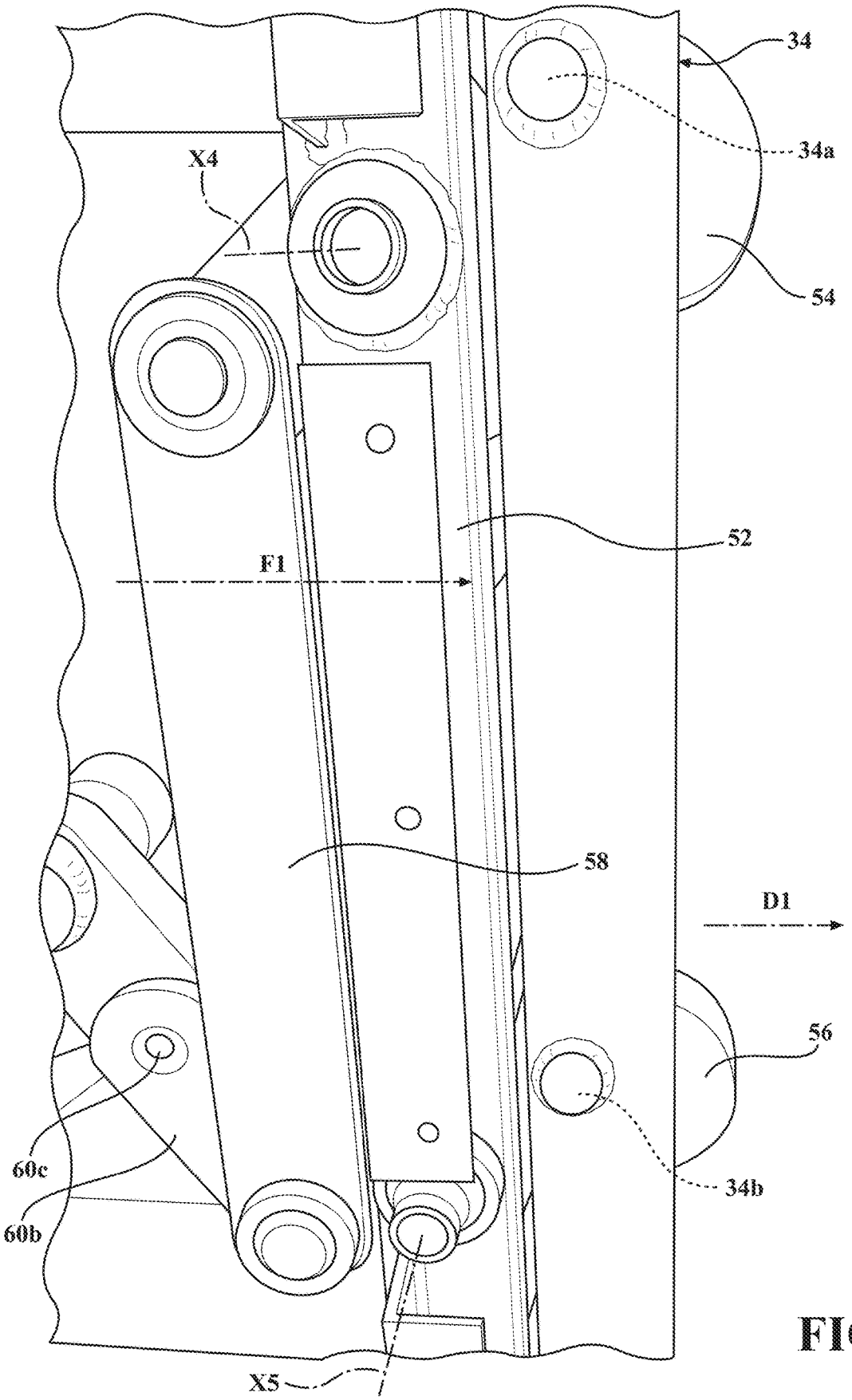
FIG. 2 is a magnified view of a portion of the side view shown in FIG. 1, with portions of a latch support member cut away to show rotational mounting of latches to an associated sidewall of a container of the receptacle.
Figure 3:
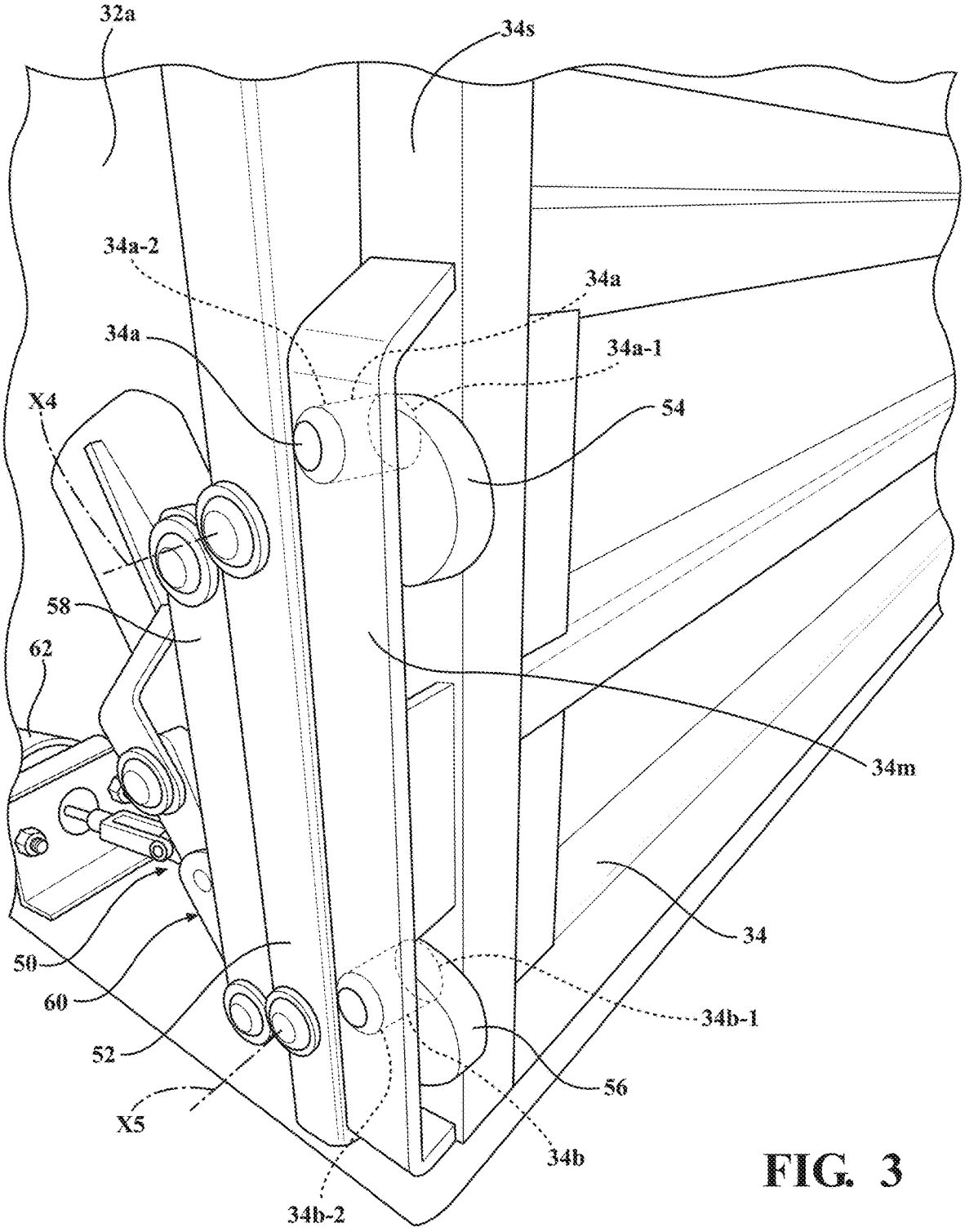
FIG. 3 is a schematic perspective view of the arrangement shown in FIG. 2.
Figure 4:
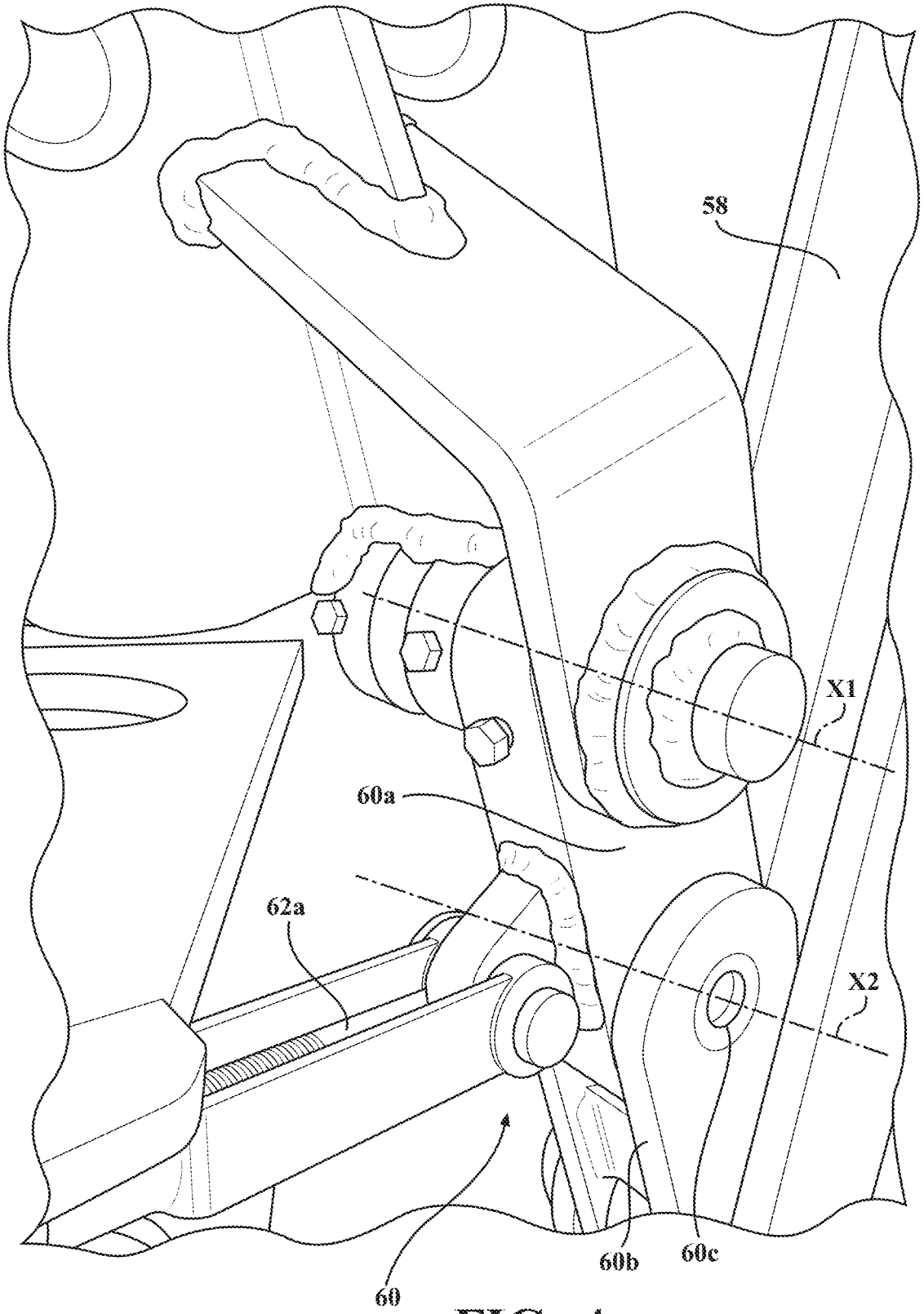
FIG. 4 is a schematic perspective view of a portion of the latching mechanism shown in FIG. 1.
Figure 7A:
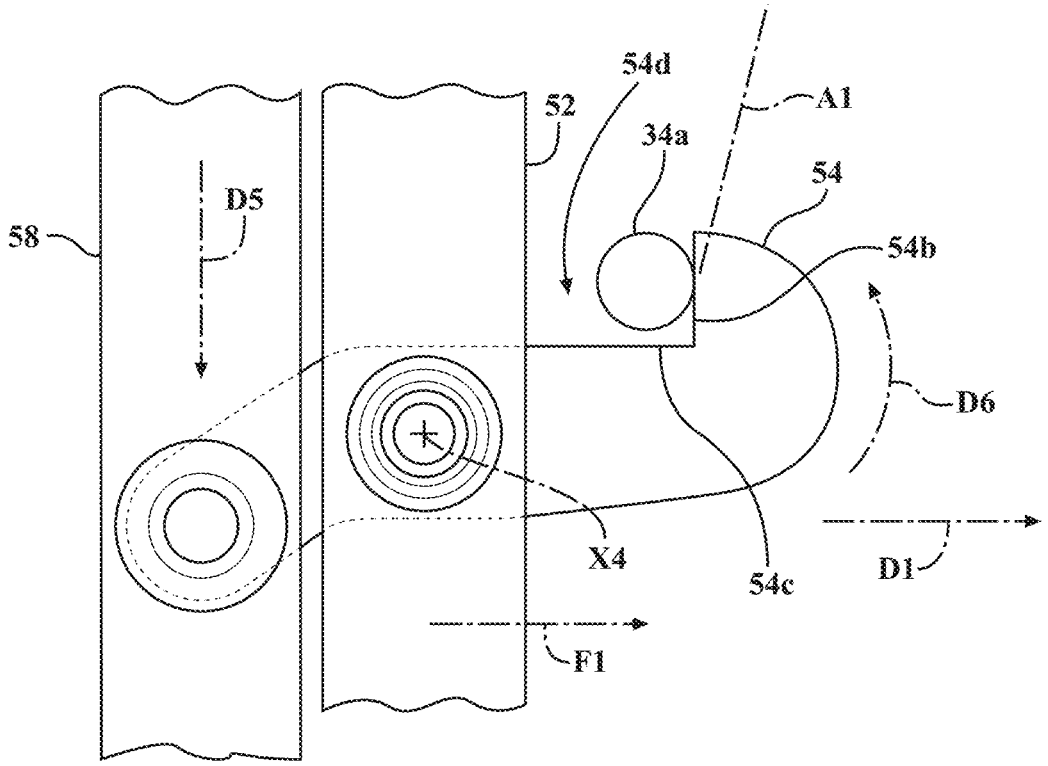
FIG. 7A is a schematic side view of a portion of the latching mechanism shown in FIG. 1, showing operation of the latching mechanism to rotate a latch to its latched orientation.

A gate 34 may be operably connected to the container 32 so as to be rotatable to (and between) an open position and a closed position. FIGS. 1, 8, and 9 show the gate 34 rotatably connected to the container 32 by hinges 32*r*. The gate 34 may be structured to close the open end 32*d* of the container 32 when in the closed position of the gate as shown in FIGS. 2 and 3, to prevent contents of the container from spilling out the open end. Gate 34 may include a rear portion 34*c* structured to close the container open end 32*d* when the gate 34 is in the closed position. FIGS. 8 and 9 show the gate 34 in various open positions. When the gate 34 is rotated to an open position, the container interior space 32*e* may be accessed through the container open end 32*d*. In one or more arrangements, gate 34 may be considered to be "open" or in an "open position" when the gate 34 is in any position or orientation in which it cannot be latched using an embodiment of the latching mechanism 50 described herein (e.g., any position or orientation of the gate in which the gate locking arms 34*a*, 34*b* (described in greater detail below) are not located such that they may be secured in latch cavities 54*d*, 56*d* of the respective latches 54, 56 by rotation of the latches in the manner shown in FIG. 7A). For example, referring to FIG. 7B, in a case where the locking arm 34*a* has been raised by rotation/lifting of the gate 34 to a position 34*a*' vertically above any portion of the latch 54 or to a position outside the latch cavity 54*d*, rotation of the latch 54 to the locking position shown in FIG. 7A will no longer be able to secure the locking arm 34*a* in the latch cavity 54*d*. In such a case, gate 34 may be considered to be "open" or in an "open position". Similarly, the gate 34 may be considered to be "closed" or in a "closed position" when it is in any position or orientation in which it can be latched and secured in an associated latch cavity using an embodiment of the latching mechanism 50 described herein (e.g., a position of the gate 34 in which a locking arm such as locking arm 34*a* may be secured in associated latch cavity 54*d* by rotation of the latch to its latched orientation, as shown in FIG. 7A). As described herein, latching of the gate 34 may involve positioning a locking arm with respect to an associated latch such that rotation of the latch to its "latched" orientation secures or confines the locking arm within a cavity defined by the latch until the latch is rotated to its "unlatched" orientation. The term "operably connected," as used throughout this description, can include direct or indirect connections, including connections without direct physical contact.

As seen in FIGS. 8 and 9, the gate 34 may be structured to rotate upwardly to an open position of the gate to enable the container to be emptied through the open end 32*d*. Referring to the drawings, a pair of locking arms 34*a*, 34*b* may extend generally horizontally from each side edge of the gate 34. Each of locking arms 34*a*, 34*b* may be structured for engagement with an associated latch of a latching mechanism 50 (as described in greater detail below). FIG. 3 shows a particular embodiment in which a locking arm support member 34*m* is rigidly attached to the gate side edge 34*s*, by welding or other suitable means. Respective first ends 34*a*-1 and 34*b*-1 of locking arms 34*a*, 34*b* may be secured in the gate side edge 34*s*. The locking arms 34*a*, 34*b* may then extend from side edge 34*s* to the locking arm support member 34*m*, to which respective second ends 34*a*-2 and 34*b*-2 are attached. The locking arms 34*a*, 34*b* may thus be supported between gate side edge 34*s* and locking arm support member 34*m*, thereby increasing the strength and rigidity of the locking arms 34*a*, 34*b*.

Referring to FIGS. 8 and 9, in particular arrangements, the gate 34 may be rotatably connected to the container sidewalls 32*a*, 32*b* at hinges 32*r* along or near uppermost portions of the sidewalls so that the gate may be simultaneously lifted and rotated to its open position by operation of a gate actuation mechanism 40 (described below). Referring to the drawings, and in particular to FIGS. 8 and 9, the gate actuation mechanism 40 may be operably connected to one or more associated sidewalls 32*a*, 32*b* of the container 32 and also to the gate 34. In particular arrangements, a separate gate actuation mechanism may be operably connected to each of sidewalls 32*a*, 32*b* and to the gate 34, so that a pair of actuation mechanisms may be operated simultaneously to open the gate. In other particular arrangements, the gate actuation mechanism 40 may be a single suitable pneumatic or hydraulic cylinder or ram located along a single side of the container. Other types of mechanisms may also be used for the gate actuation mechanism. Referring to FIG. 9, the gate actuation mechanism 40 may be connected to the container 32 at a rotatable connection 40*a* (such as a bolted connection) so as to be rotatable at one end thereof, to accommodate movement of the gate 34 during rotation of the gate as the gate is opened and closed.

Referring to FIGS. 1, 3-7B and 9, the receptacle 30 may include a latching mechanism 50 structured to engage the gate 34 to maintain the gate in the closed condition. In the following description, an embodiment of the latching mechanism 50 as operably connected to the container 32 along one sidewall 32*a* of the container will be described. However, it will be understood that a separate latching mechanism having the same elements, configuration, and operation may also be operably connected to the opposite sidewall 32*b*.

The latching mechanism 50 may include a latch support member 52 fixedly attached to the container sidewall 32*a*. The latch support member 52 may be structured to rotatably support one or more associated latches between the container sidewall 32*a* and the latch support member 52. The embodiment described includes a pair of latches 54, 56 mounted along container sidewall 32*a*. However, fewer than two latches or more than two latches may be mounted along a given sidewall depending on the requirements of a particular application. An additional pair of latches 154, 156 may be similarly mounted along the container second sidewall 32*b*.

Figure 1A:
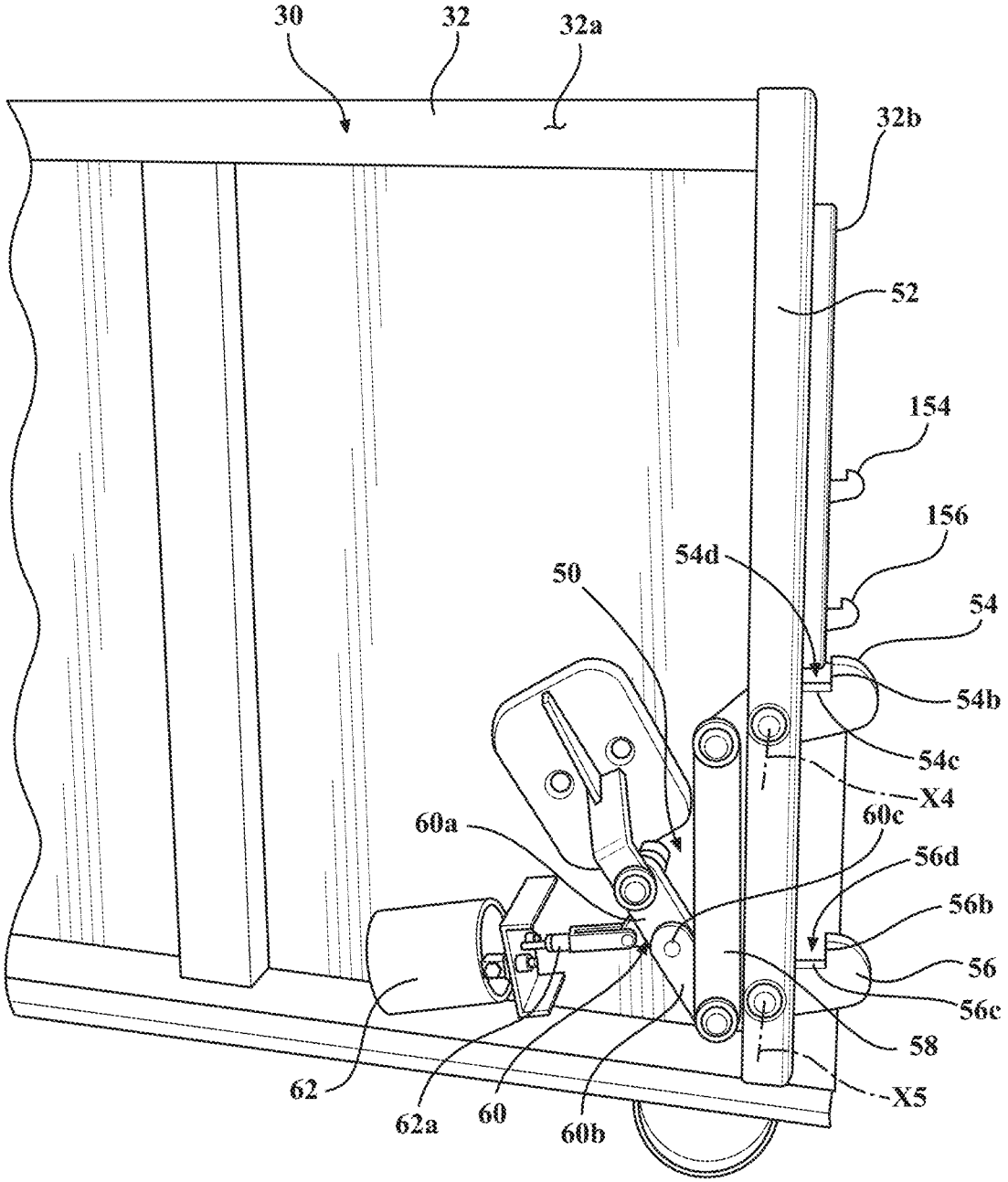
FIG. 1A is a magnified partial side view of an end of the receptacle of FIG. 1, shown with the receptacle gate removed and latches of the latching mechanism shown in their latched orientations.
Figure 7B:
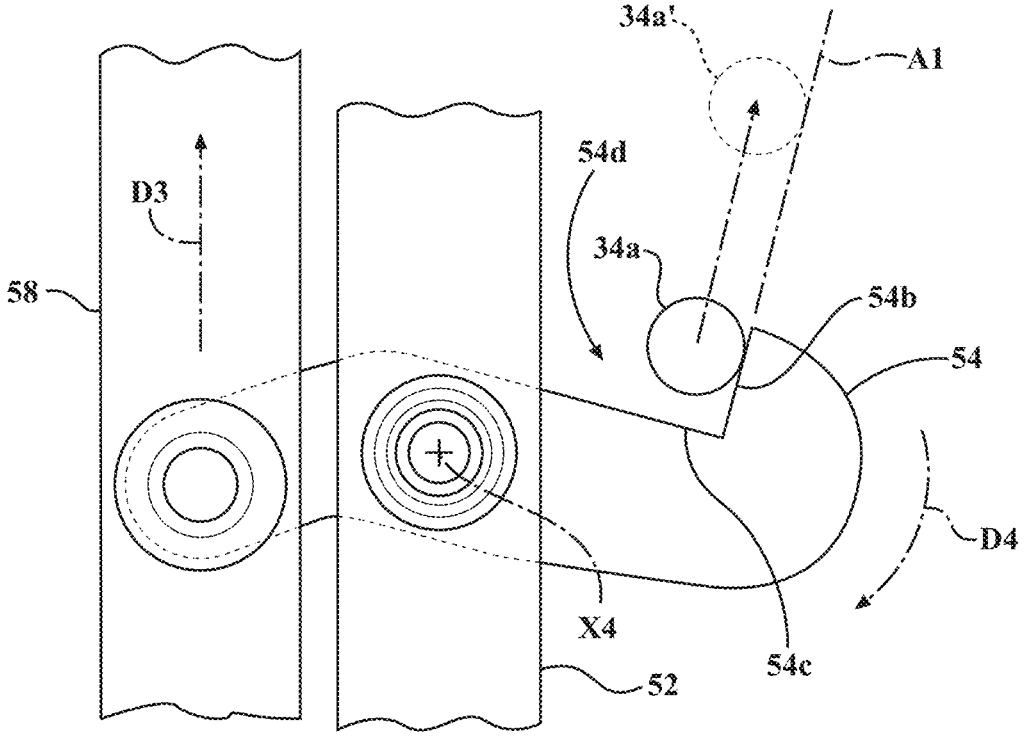
FIG. 7B is a schematic side view of a portion of the latching mechanism shown in FIG. 1, showing operation of the latching mechanism to rotate a latch to its unlatched orientation.
Figure 8:
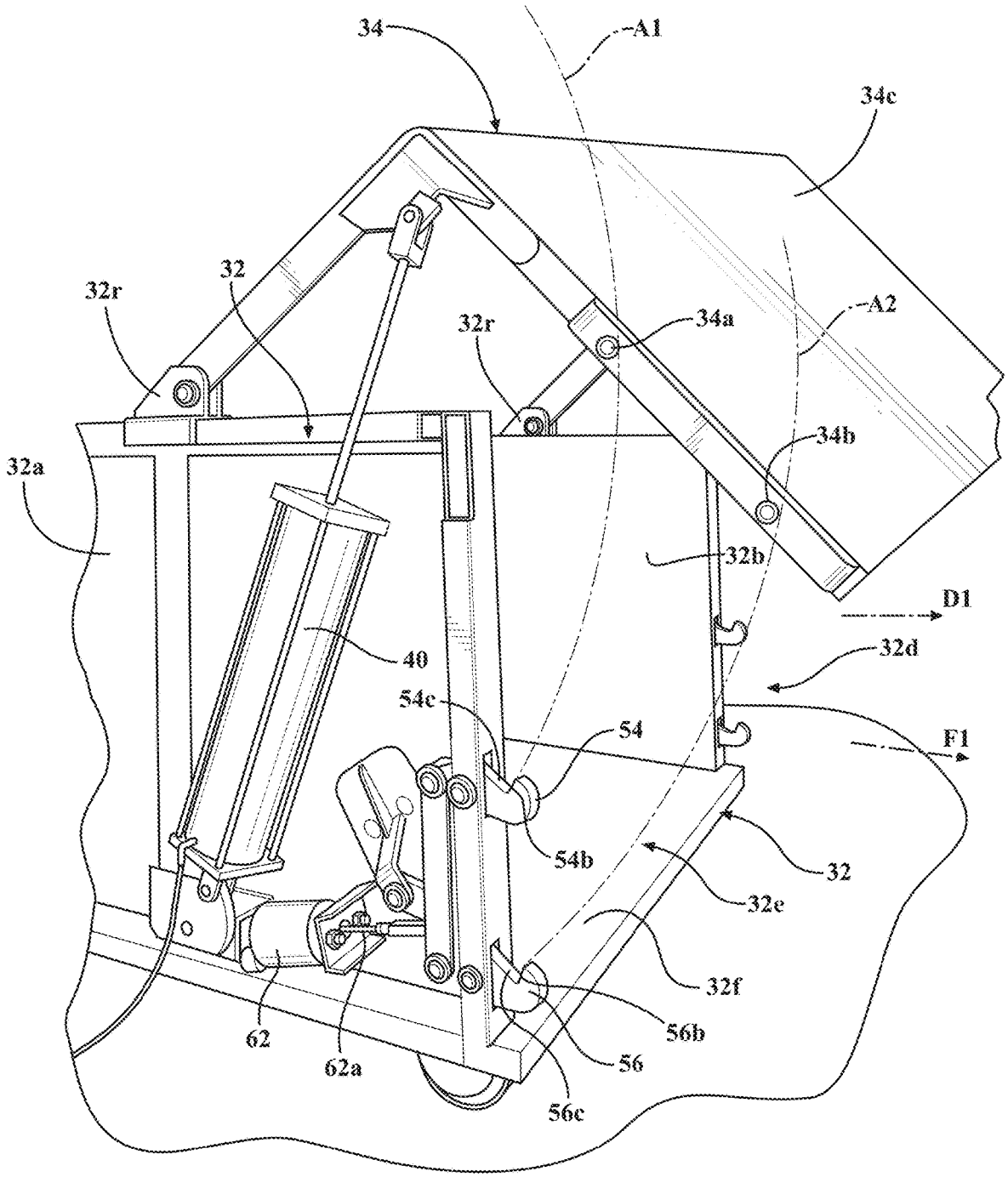
FIG. 8 is a magnified schematic perspective view of an end of the receptacle of FIG. 1, showing rotation of the gate to raise and open the gate after the latches have been disengaged from locking arms on the gate.
Figure 9:
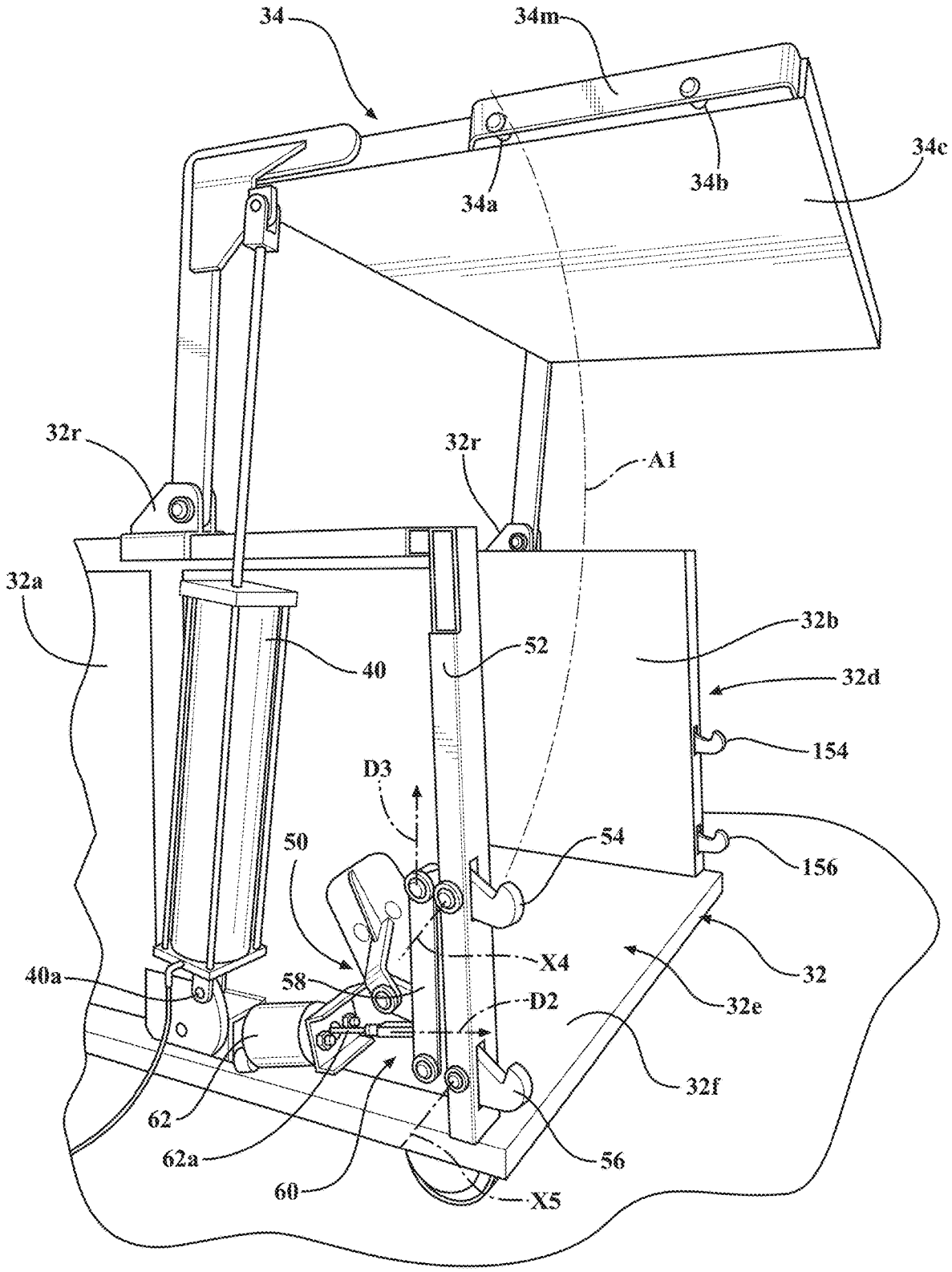
FIG. 9 is a magnified schematic perspective view of an end of the receptacle shown in FIGS. 1 and 8, showing further rotation of the gate to a fully open position.

Each of latches 54, 56 may be connected to the latch support member 52 so as to be rotatable about an associated fixed rotational axis (axis X4 for latch 54 and axis X5 for latch 56) between a first, latched orientation (shown in FIGS. 1A and 7A) and a second, unlatched orientation (shown in FIGS. 1, 7B, 8, and 9). Referring in particular to FIGS. 7A and 7B, each of latches 54, 56 may include an associated first bearing surface (54*b*, 56*b* for latches 54, 56, respectively) structured to engage an associated one of locking arms 34*a*, 34*b* extending from a side edge of the gate 34. This engagement prevents a rearward motion (in direction D1, FIGS. 7A, 8) of the gate 34 responsive to forces F1 exerted by the contents of the container 32 on the gate 34, thereby maintaining the gate in the closed position. Each of latches 54, 56 may also include an associated second bearing surface (54*c* and 56*c* for latches 54 and 56, respectively). A rearward motion of any portion of the receptacle may be motion in a direction leading from the container interior space 32*e* toward the container open end 32*d*. Referring to FIGS. 1, 7A and 7B, first and second bearing surfaces 54*b* and 54*c* of latch 54 may, in combination, define a cavity 54*d* structured to receive an associated locking arm 34*a* therein. In the embodiment shown in FIGS. 7A-7B, a surface of the latch support member 52 may also define a boundary of the cavity 54*d*. Similarly, first and second bearing surfaces 56*b* and 56*c* of latch 56 may, in combination, define a cavity structured to receive locking arm 34*b* therein.

Each latch of the receptacle 30 may be structured so that an associated first bearing surface of the latch always makes direct physical contact with an associated locking arm received in the latch cavity when the gate is in its closed position and the latch is in its latched orientation. In addition, referring to latch 54 in FIGS. 7A and 7B as an example, the first bearing surface 54*b* may be angled with respect to the associated locking arm 34*a* and an arc of travel A1 of the locking arm 34*a* so that, when the latch 54 is in the latched orientation shown in FIG. 7A securing the gate 34 in the closed position, the first bearing surface 54*b* may operate to prevent the locking arm 34*a* from being lifted in an upward and rearward motion out of the cavity 54*d* and along the arc A1 by rotation of the gate 34. Thus, the latch 54 must be rotated from the latched orientation in FIG. 7A to the unlatched orientation as shown in FIG. 7B in order to extract the locking arm 34*b* from the cavity 54*d* without damaging the latching mechanism 50 and/or the gate actuation mechanism 40. Each of latches 56, 154, and 156 may have a similar structure, being configured so that the respective latches must be rotated to unlatched orientations similar to that shown in FIG. 7B in order to enable movement of the locking arm along an associated arc of travel, thereby allowing extraction of the associated locking arms from the associated cavities without damaging the latching mechanism 50 and/or the gate actuation mechanism 40.

The latching mechanism 50 may include a latch link 58 operably connecting the first and second latches 54, 56. Each of the first and second latches 54, 56 may be connected to the latch link 58 so as to be rotatable between the respective latched orientation (FIGS. 1A and 7A) and the respective unlatched orientation (FIGS. 1, 7B, 8, and 9) by movement of latch link 58. The latch link 58 may connect the first and second latches 54, 56 so that movement of the latch link as described herein causes the first and second latches to rotate simultaneously. The latch link 58 may also be rotatably connected to the latch control linkage second link 60*b* (described below).

Referring to FIGS. 3-6, the latching mechanism 50 may include a latch control linkage 60. The latch control linkage 60 may be structured and connected to other elements of the latching mechanism so as to enable control of movement of the latch link 58 by operation of the latch control linkage 60. In one or more arrangements, the latch control linkage 60 may include a first link 60*a* rotatably connected to container sidewall 32*a* along a fixed rotational axis X1. The first link 60*a* may also be rotatably connected to a second link 60*b* of the latch control linkage 60 at a link junction 60*c* along a movable axis of rotation X2. The second link 60*b* may also be rotatably connected to the latch link 58 along a movable axis of rotation X3.

The latching mechanism 50 may also include a latch control linkage actuation mechanism 62 operably connected to the latch control linkage 60 and structured to control operation of the latch control linkage 60. In one or more arrangements, the latch control linkage actuation mechanism 62 may include a suitable pneumatic or hydraulic cylinder or ram. Other types of mechanisms may also be used for the gate actuation mechanism.

FIGS. 1A and 7A-9 illustrate operation of the latching mechanism 50 and opening of the gate 34. Although operation of the latching mechanism 50 will be described in terms of the effects on a single latch 54, it will be understood that the operations described will have a similar effect on any other latches (i.e., latches 56) connected to the single latch by a latch link along the same side of the container. The structure and operations of any latching mechanism and other elements mounted along the container sidewall 32*b* will also be the same as those described for the latching mechanism and other elements mounted along the container sidewall 32*a*.

A human user may remotely control operation of the latch control linkage actuation mechanism 62 and gate actuation mechanism 40 to open the gate 34. This obviates the need for the human user to be in close proximity to the receptacle during opening or to manually attempt to open the gate 34 when the gate is under a load exerted by contents of the container, thereby reducing the risk of injury to the user.

Figure 5:
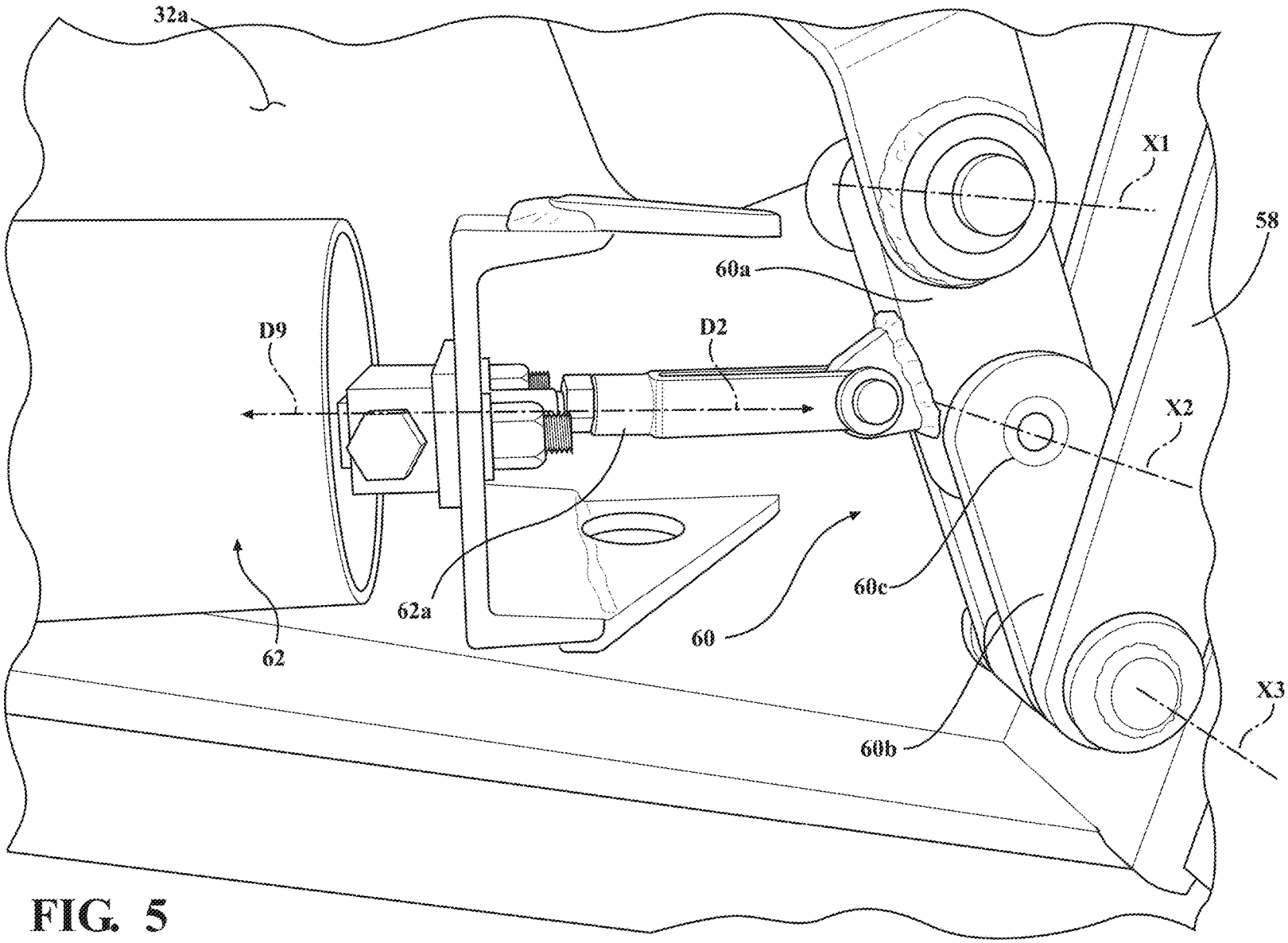
FIG. 5 is a schematic side view of a portion of the latching mechanism shown in FIG.
Figure 6:
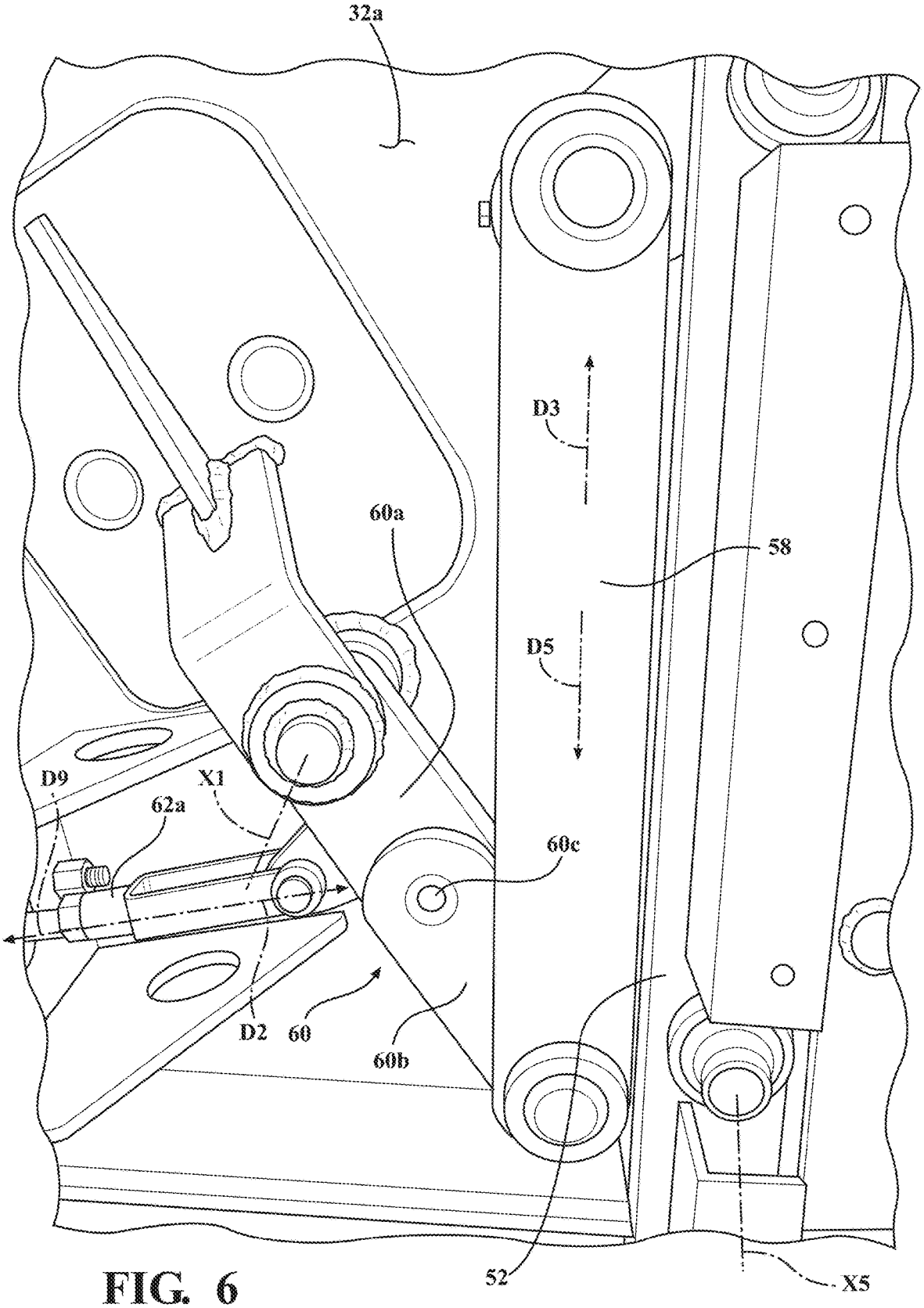
FIG. 6 is a schematic side view of another portion of the latching mechanism shown in FIG. 1.

To open the gate 34, the user may first control operation of the latch control linkage actuation mechanism/cylinder 62 to rotate the latch 54 to its unlatched orientation. In the embodiment shown, the latch control linkage actuation mechanism may be controlled to retract a piston shaft 62*a* of the cylinder 62 in direction D9 (FIG. 5). This moves the link junction 60*c* attached to the piston shaft 62*a* in a direction away from the latch link 58, which causes the latch link 58 attached to the latch control linkage second link 60*b* to move in direction D3 (FIGS. 6 and 7B). This motion of the latch link 58 causes the attached latch 54 to rotate about its axis of rotation X4 in direction D4 to its unlatched orientation. This has the effect of rotating the latch bearing surface 54*b* so that the bearing surface is substantially aligned with a portion of an arc of rotation A1 that the associated locking arm 34*a* will follow during movement of gate 34 toward the open position (as shown in FIG. 7B), while at the same time maintaining the bearing surface 54*b* in a position to resist any forces F1 exerted by the contents of the container on the gate 34.

As seen in FIG. 7B, the substantial alignment of the bearing surface 54*b* with the locking arm rotational arc A1 when the latch 54 is in its unlatched orientation enables the locking arm 34*a* to slide upwardly along the first bearing surface 54*b* and facilitates upward rotation of the gate 34 by the gate actuation mechanism 40, by reducing the force needed to separate the locking arm 34*a* from the latch. FIG. 7B shows the locking arm 34*a* in a position 34*a*' along its arc of rotation A1 after separating from the latch 54 and as the gate 34 is lifted upwardly (FIG. 8). A similar effect is realized in the other latch 56 (FIG. 8) as this latch is also rotated along an associated arc A2 by movement of the latch link 58. The gate actuation mechanism 40 may then continue to raise the gate 34 to the fully open position shown in FIG. 9.

The angle of the bearing surface 54*b* with respect to the arc of travel A1 of the locking arm 34*a* in the latched and unlatched orientations of the latch 54 may be adjusted to achieve the effects just described by adjusting the amount the latch 54 will rotate for a given stroke length or movement of the latch link 58. The amount of rotation of each latch for a given stroke length of the latch link can be individually controlled by adjusting such parameters as the dimensions of the latch and the location of the rotational connection between the latch link and the latch with respect to the rotational axis of the respective latch. Values of optimum design parameters (such as the angle of the latch bearing surface with respect to a projected arc of travel of an associated locking arm, the required amount of rotation of the latch to enable the locking arm to exit the associated latch cavity, the location of the rotational axis of the latch, and other parameters) for each latch and component spatial arrangements for a given application may be determined analytically and/or iteratively by experimentation.

To close the gate 34 and operate the latching mechanism 50 to lock the gate in the closed position, the process just described may be reversed. The gate actuation mechanism 40 may be operated to rotate the gate 34 back to the closed position shown in FIGS. 2 and 3, with the locking arm 34*a* seated in latch cavity 54*d*. The linkage actuation mechanism/cylinder 62 may then be operated to extend the piston shaft 62*a* (in direction D9, FIG. 5), causing the link junction 60*c* to move in direction D2, in a direction toward the latch link 58. This causes the latch link 58 to move in direction D5 (FIG. 7A) which rotates the latch 54 in direction D6 toward its latched orientation, thereby securing the locking arm 34*a* in the latch cavity 54*d* and securing the gate 34 in its closed position.

Figure 10:
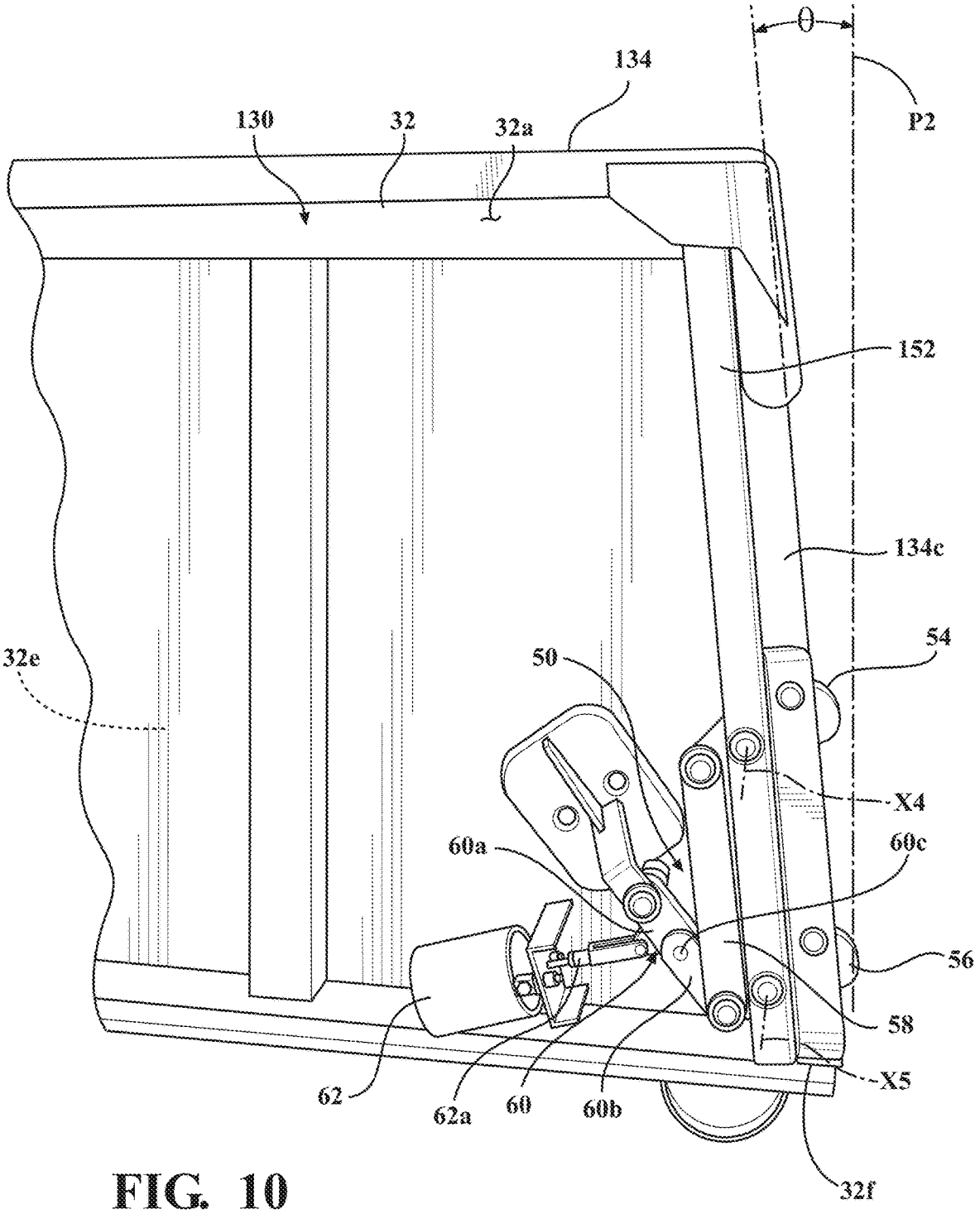
FIG. 10 is a magnified partial side view of an end of a receptacle in accordance with an alternative embodiment of the invention.

FIG. 10 is a magnified partial side view of an end of a receptacle structured in accordance with an alternative embodiment of the invention. FIG. 10 shows a gate 134 of the receptacle in the closed position. Referring to FIG. 10, in an alternative version 130 of the receptacle, the receptacle gate 134 may include a rear portion 134*c* (similar to previously described rear portion 34*c*) structured to close the container open end 32*d* when the gate is in the closed position. In addition, gate rear portion 134*c* may be structured to be sloped with respect to a plane P2 extending perpendicular to a floor 32*f* of the container 32 when the gate 134 is in its closed position. The rear portion 134*c* may be structured to slope in a direction from the floor 32*f* of the container 32 toward the interior space 32*e* of the container.

In one or more particular arrangements, the gate rear portion 134*c* may be sloped so as to "lean" toward the container interior space 32*e* a horizontal distance of about 2 inches for every 60 inches that the rear portion 134*c* extends vertically upwardly from the container floor 32*f*. This degree of slope may provide a receptacle in which the gate rear portion is sloped at an angle θ in a range of 2°-3° inclusive with respect to the plane P2 extending perpendicular to the floor 32*f* of the container. In other particular arrangements, the gate rear portion 134*c* may be structured to be sloped at an angle θ in a range of 2°-10° inclusive with respect to the plane P2 extending perpendicular to the floor 32*f* of the container, depending on the requirements of a particular application.

To provide latching and release of the gate 134 in the manner previously described herein with regard to gate 34, the receptacle 130 may include a latch support member 152 fixedly attached to the container sidewall 32*a* in a manner similar to that of latch support member 52 previously described. The latch support member 152 may be structured to rotatably support one or more associated latches (such as latches 54 and 56) between the container sidewall 32*a* and the latch support member 152. However, the latch support member 152 may be attached to the container sidewall 32*a* so as to be sloped at the same angle that the gate rear portion 134*c* slopes when the gate 134 is in the closed position. This sloping of the latch support member 152 may cause the lower latch 56 to be spaced relatively farther in a rearward direction of the container than the upper latch 54. This sloping of the latch support member 152 adjusts the positions of the latches 54 and 56 and the relative locations at which the latches 54 and 56 are rotatably supported by the latch support member 152, to accommodate the positions of the associated locking arms 34*a*, 34*b* along the sloped rear portion 134*c* of the gate 134.

Another sloped latch support member (not shown) may be attached to the opposite container sidewall 32*b* in the manner described herein, for supporting latches 154 and 156. Operation of the latches 54, 56, 154, 156 and the other elements and mechanisms of the receptacle are as previously described with respect to FIGS. 1-9.

Sloping of the gate rear portion 134*c* (and the support to the gate latches provided by a similar sloping of the latch support member 152) may facilitate opening of the gate 134 from a closed positon and emptying of the container contents when a large load is acting on the rear portion from the container interior space 32*e*, by reducing the load component acting parallel to the container floor 32*f* and on the gate rear portion 134*c*.

Also disclosed herein is a method of releasably securing a gate of a receptacle in a closed position. The receptacle is structured for holding a quantity of solid material therein, and includes a container having an open end and a gate operably connected to the container so as to be rotatable to a closed position structured to prevent solid material from exiting the container through the open end. The gate is structured and operably connected to the container so that a portion of the gate moves rearwardly and upwardly during rotation of the gate in order to rotate the gate out of the closed position. The method includes steps of attaching a locking arm to the portion of the gate and operably connecting a latch to the container so as to be rotatable with respect to the container to a latched orientation and an unlatched orientation. The latch is structured to contact the locking arm when the latch is in the latched orientation so as to prevent rearward and upward motion of the locking arm during attempted rotation of the gate out of the closed position. The method also includes a step of rotating the latch into the latched orientation.

The latch may also be structured to enable rearward and upward motion of the locking arm during attempted rotation of the gate out of the closed position when the latch is in the unlatched orientation. The method may then further include a step of rotating the latch into the unlatched orientation to enable rearward and upward motion of the locking arm and the portion of the gate attached to the locking arm.

In one or more arrangements, the step of attaching a locking arm to the portion of the gate includes a step of attaching a pair of locking arms to the portion of the gate, and the step of operably connecting a latch to the container includes a step of operably connecting a pair of latches to the container, each latch being connected to the container so as to be rotatable with respect to the container to a respective latched orientation and a respective unlatched orientation, each latch being structured to contact an associated one of the locking arms when the latch is in the respective latched orientation so as to prevent rearward and upward motion of the locking arm during attempted rotation of the gate out of the closed position. In addition, the method may further include steps of operably connecting a latch link to the latches such that movement of the latch link causes the latches to rotate simultaneously, and controlling a movement of the latch link so that each of the latches rotates in a direction toward its respective latched orientation.

In one or more arrangements, the movement of the latch link in a first direction causes a simultaneous rotation of the latches toward the respective latched orientations of the latches, and movement of the latch link in a second direction opposite the first direction causes a simultaneous rotation of the latches toward the respective unlatched orientations of the latches.

In one or more arrangements, the method may further include a step of operably connecting a latch control linkage to the latch link, the latch control linkage including, and a first link rotatably connected to the container along a fixed rotational axis, and a second link rotatably connected to the first link at a link junction and rotatably connected to the latch link, such that movement of the link junction in a direction away from the latch link produces a movement of the latch link in the second direction, and movement of the link junction in a direction toward the latch link produces a movement of the latch link in the first direction. The method may further include a step of controlling operation of the latch control linkage to move the link junction in the direction toward the latch link.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-10, but the embodiments are not limited to the illustrated structure or application.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A receptacle structured for holding a quantity of solid material, the receptacle comprising:

a container having an open end;

a gate operably connected to the container so as to be rotatable to a closed position structured to prevent solid material from exiting the container through the open end, the gate including a locking arm mounted thereon; and a latching mechanism operably connected to the container and including a latch rotatable to a latched orientation structured to contact the locking arm to prevent the gate from being rotated out of the closed position, wherein the gate is structured and operably connected to the container so that the locking arm moves rearwardly and upwardly during rotation of the gate in order to rotate the gate out of the closed position, and wherein the latch is structured so that contact between the latch and the locking arm when the latch is in the latched orientation prevents rearward and upward movement of the locking arm.

2. The receptacle of claim 1, wherein the latch is rotatable to an unlatched orientation to enable rearward and upward movement of the locking arm, to enable movement of the gate out of the closed position.

3. The receptacle of claim 1, wherein the latch includes a first bearing surface defining a portion of a cavity in which the locking arm is received when the gate is in the closed position, and wherein the latch is structured so that contact between the first bearing surface and the locking arm when the latch is in the latched orientation prevents movement of the locking arm out of the cavity.

4. The receptacle of claim 1, wherein the gate is structured and operably connected to the container so that the locking arm moves rearwardly and upwardly during rotation of the gate in order to rotate the gate out of the closed position, and wherein the latch is structured so that contact between the latch and the locking arm when the latch is in the latched orientation prevents movement of the locking arm to a position vertically above the latch.

5. The receptacle of claim 1, wherein the gate includes a pair of locking arms, and wherein the latching mechanism includes:

a pair of latches, each latch being rotatable to a latched orientation structured to enable contact with an associated one of the locking arms to prevent the gate from being rotated out of the closed position; and a latch link operably connecting the latches such that movement of the latch link causes the latches to rotate simultaneously.

6. The receptacle of claim 5, wherein movement of the latch link in a first direction causes a simultaneous rotation of the latches toward respective latched orientations of the latches, and wherein movement of the latch link in a second direction opposite the first direction causes a simultaneous rotation of the latches toward respective unlatched orientations of the latches.

7. The receptacle of claim 6, further comprising a latch control linkage including:

a first link rotatably connected to the container along a fixed rotational axis; and a second link rotatably connected to the first link at a link junction and rotatably connected to the latch link, such that movement of the link junction in a direction away from the latch link produces a movement of the latch link in the second direction, and movement of the link junction in a direction toward the latch link produces a movement of the latch link in the first direction.

8. The receptacle of claim 7, further comprising a latch control linkage actuation mechanism operably connected to the latch control linkage and structured for controlling movement of the link junction in directions toward and away from latch link.

9. The receptacle claim 1, further comprising a gate actuation mechanism operably connected to the gate and operably connected to the container so as to be rotatable with respect to the container.

10. The receptacle of claim 1, wherein the latch includes a first bearing surface defining a portion of a cavity in which the locking arm is received when the gate is in the closed position, wherein the locking arm is structured to move along an arc extending along a vertical plane to exit the cavity as the gate is moved out of the closed position, and wherein the latch is structured so that contact between the first bearing surface and the locking arm when the latch is in the latched orientation prevents movement of the locking arm along the arc.

11. The receptacle of claim 1 wherein the gate has a rear portion structured to close the container open end when the gate is in the closed position, and wherein the gate rear portion is structured to be sloped in a direction toward a front of the container, proceeding upwardly from a floor of the container, when the gate is in the closed position.

12. The receptacle of claim 11 wherein the gate rear portion is structured to be sloped at an angle in a range of 2°-10° inclusive with respect to the plane extending perpendicular to the floor of the container.

13. The receptacle of claim 12 wherein the gate rear portion is structured to be sloped at an angle in a range of 2°-3° inclusive with respect to the plane extending perpendicular to the floor of the container.

14. A method of releasably securing a gate of a receptacle in a closed position, the receptacle being structured for holding a quantity of solid material therein, the receptacle including a container having an open end and a gate operably connected to the container so as to be rotatable to a closed position structured to prevent solid material from exiting the container through the open end, the gate being structured and operably connected to the container so that a portion of the gate moves rearwardly and upwardly during rotation of the gate in order to rotate the gate out of the closed position, the method comprising steps of:

attaching a locking arm to the portion of the gate;

operably connecting a latch to the container so as to be rotatable with respect to the container to a latched orientation and an unlatched orientation, the latch being structured to contact the locking arm when the latch is in the latched orientation so as to prevent rearward and upward motion of the locking arm during attempted rotation of the gate out of the closed position; and rotating the latch into the latched orientation.

15. The method of claim 14, wherein the latch is structured to enable rearward and upward motion of the locking arm during attempted rotation of the gate out of the closed position when the latch is in the unlatched orientation, and wherein the method further comprises a step of rotating the latch into the unlatched orientation to enable rearward and upward motion of the locking arm and the portion of the gate attached to the locking arm.

16. The method of claim 14, wherein the step of attaching a locking arm to the portion of the gate comprises a step of attaching a pair of locking arms to the portion of the gate, wherein the step of operably connecting a latch to the container comprises a step of operably connecting a pair of latches to the container, each latch being connected to the container so as to be rotatable with respect to the container to a respective latched orientation and a respective unlatched orientation, each latch being structured to contact an associated one of the locking arms when the latch is in the respective latched orientation so as to prevent rearward and upward motion of the locking arm during attempted rotation of the gate out of the closed position, and wherein the method further comprises steps of:

operably connecting a latch link to the latches such that movement of the latch link causes the latches to rotate simultaneously; and controlling a movement of the latch link so that each of the latches rotates in a direction toward its respective latched orientation.

17. The method of claim 16, wherein movement of the latch link in a first direction causes a simultaneous rotation of the latches toward the respective latched orientations of the latches, and wherein movement of the latch link in a second direction opposite the first direction causes a simultaneous rotation of the latches toward the respective unlatched orientations of the latches.

18. The method of claim 17, further comprising steps of:

operably connecting a latch control linkage to the latch link, the latch control linkage including:

a first link rotatably connected to the container along a fixed rotational axis; and a second link rotatably connected to the first link at a link junction and rotatably connected to the latch link, such that movement of the link junction in a direction away from the latch link produces a movement of the latch link in the second direction, and movement of the link junction in a direction toward the latch link produces a movement of the latch link in the first direction; and controlling operation of the latch control linkage to move the link junction in the direction toward the latch link.

* * * * *